United States Patent [19]

Duncan et al.

[11] 4,025,289

[45] May 24, 1977

[54] FIREWORKS DEVICE

[75] Inventors: Bonnie Sue Duncan; Edward Russell Duncan, both of Traverse City, Mich.

[73] Assignee: Edward Russell Duncan, Lake, Mich.

[22] Filed: Aug. 25, 1975

[21] Appl. No.: 607,359

[52] U.S. Cl. ..... 102/37.4; 102/37.8; 431/296

[51] Int. Cl.[2] ..... F42B 4/20; F42B 4/00

[58] Field of Search ..... 431/126, 291, 296, 327; 102/31, 32, 37.4, 37.8

[56] References Cited

UNITED STATES PATENTS

| | | | |
|---|---|---|---|
| 385,562 | 7/1888 | Mannie | 102/37.8 |
| 1,088,606 | 2/1914 | McGinley | 102/37.8 |
| 1,818,478 | 8/1931 | Hitt | 102/37.4 |
| 2,603,277 | 7/1952 | Andres | 431/327 |
| 3,248,907 | 5/1966 | Watson | 431/291 |
| 3,257,802 | 6/1966 | Kaufman | 149/2 |

*Primary Examiner*—John J. Vrablik
*Assistant Examiner*—L. T. Casaregola
*Attorney, Agent, or Firm*—Price, Heneveld, Huizenga & Cooper

[57] ABSTRACT

The specification discloses a fireworks device including suspended body of flame dripping low molecular weight polyethylene material which produces a shower of flaming beads when ignited.

16 Claims, 4 Drawing Figures

FIREWORKS DEVICE

BACKGROUND OF THE INVENTION

This invention relates to an article for a fireworks or pyrotechnic display and in particular to an article for producing a shower of flaming beads.

Among the various types of prior art fireworks producing a visual display is a device in accordance with U.S. Pat. No. 1,818,474 issued to T. G. Hitt on Aug. 11, 1931. The Hitt patent teaches adhering aluminum particles to a sheet of paper with a plastic paste, whereupon the paper is folded upon itself so as to enclose on both sides the adhered aluminum particles, forming a laminated sheet. Igniting the laminated material produces a dispersal of burning aluminum sparks.

Fabrication of a fireworks device in accordance with the Hitt patent requires several fabricating steps including forming the sheet of material, mixing the aluminum particles and the paste and particle mix on the material, and folding the material to form the laminate. Since each step necessarily adds to the cost of the finished product, the cost of the finished fireworks device can be greater than that desired, particularly with the cost of aluminum particles. Cost is particularly important in fireworks because the fireworks are single-use items and the customer may completely refrain from purchase of the fireworks if the cost is not sufficiently low for the amount of excitement generated by the device.

The prior art also includes U.S. Pat. No. 910,755 issued to F. J. Welter on Jan. 28, 1909 which teaches spark emitting candles formed by a composition of metallic powder and salts rich in oxygen. The composition is formed in a pasty condition into pencils or applied to a support. The materials suggested by the patent typically result in an undesirably high cost for each spark producing article.

SUMMARY OF THE INVENTION

The fireworks device of this invention results in flame producing, noise creating articles at a desirably low cost and having simple fabrication steps readily adaptable to mass production. Polyethylene is formed into a body with a suspension means at one end and igniting means at the other. When the polyethylene is ignited via the igniting means, the flaming body emits flaming droplets which make a curious, zipping noise. Fabrication is straight forward and polyethylene is economical. Accordingly, a reasonably priced device is provided which yields a highly attractive and desirable pyrotechnic effect.

In accordance with a preferred embodiment of this invention the fireworks device has a shield to insure that the fire of the burning material is kept under control, does not blow out in wind and that the burning particles for the attractive effect drop directly downward. Thus, the shield helps increase the relative safety of use of the fireworks device in the presence of a wind.

DESCRIPTION OF THE PREFERRED EMBODIMENT

Figure 1:
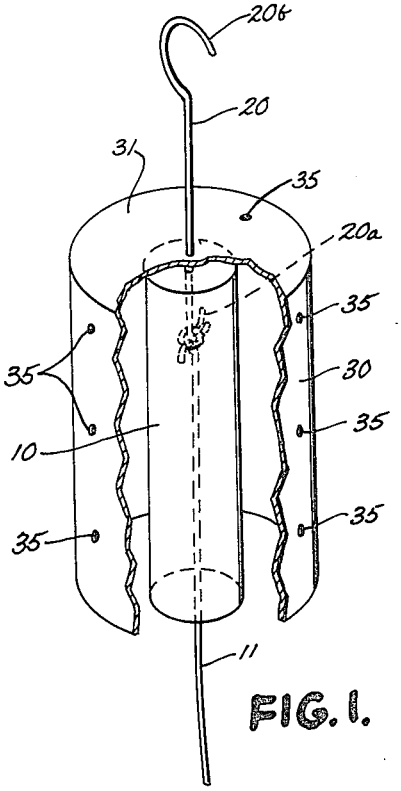
FIG. 1 is a perspective view partially in cross section of a firework device in accordance with an embodiment of this invention.
Figure 2:
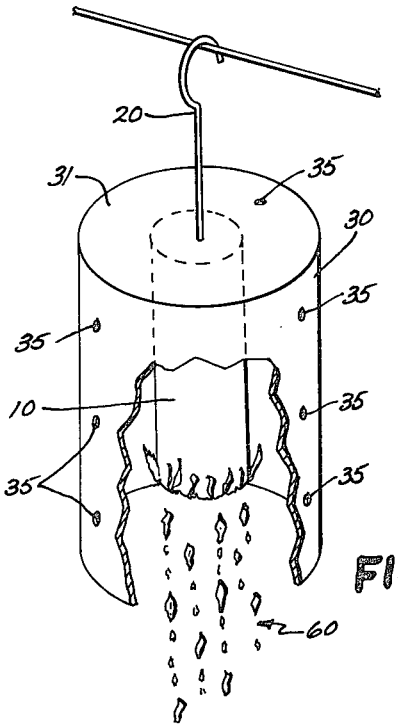
FIG. 2 is a view of the firework device shown in FIG. 1 during actual use.

In accordance with a preferred embodiment of this invention an elongated generally cylindrically shaped polyethylene body 10 has a wick 11 extending out from the bottom of body 10 along its central axis (FIGS. 1 and 2). A hanger 20 extends upward from the top of body 10 along its central axis and extends through a hole in the top cap 31 of shield 30. Shield 30 is generally a hollow cylinder having a top which is closed by top cap 31. The bottom end of shield 30 is open exposing wick 11 and the bottom of body 10.

Polyethylene body 10 is molded much like a candle. Wick 11 is tied at one end to a bottom hook **20*a* on the bottom of wire hanger 20. Body 10 is then molded therearound so that a portion of wick 11 and a portion of hanger 20, including bottom hook 20*a*, are embedded therein. A top hook 20*b* on hanger 20** enables one to suspend the device on a clothesline or the like.

Figure 3:
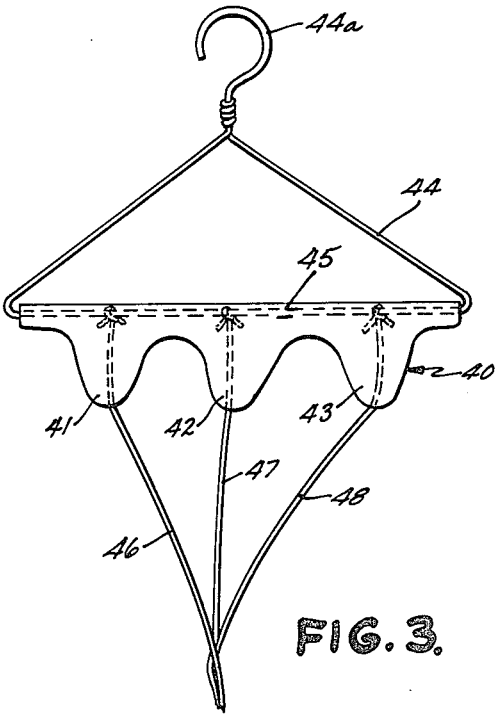
FIG. 3 is a front elevation view of a firework device in accordance with an alternative embodiment of this invention.
Figure 4:
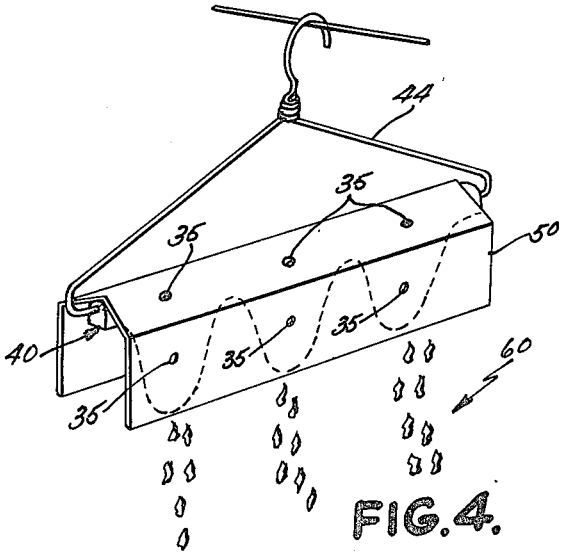
FIG. 4 is a perspective view of the firework device shown in FIG. 3 with the addition of a shield and shown during use.

In an alternative embodiment of this invention (FIGS. 3 and 4) the polyethylene is shaped into a burnable body 40 having a generally horizontally elongated shape with vertical downward protrusions 41, 42 and 43. Body 40 is partially formed around a hanger 44 shaped like a wire clothes hanger, having a horizontal member 45 directly supporting body 40 and a top hook **44*a* for suspending the device on a clothesline or the like. Wicks 46, 47 and 48 are tied to horizontal wire 45 and extend downward from the lowermost portion of protrusions 41, 42 and 43, respectively. If desired, wicks 46, 47 and 48 can be joined as shown to facilitate lighting of the fireworks article. Protrusions 41, 42 and 43 are sufficiently spaced from one another and extend sufficiently downward that each protrusion can serve as a distinct and independent source of flaming, "zipping" beads. A shield 50 as shown in FIG. 4 can be placed on body 40 to control the burning of body 40 and protect the fireworks article from wind. Shield 50 is a generally horizontally elongated member having an open bottom, open ends, and side members extending downward to at least the bottom most portion of protrusions 41, 42 and 43. Advantageously, wicks 46, 47 and 48 extend downward beyond shield 50. Shield 50 has a central longitudinal tent shaped section which rests over the top of body 40 thereby being indirectly supported by horizontal member 45.**

Bodies 10 and 40 are fabricated from a polyethylene material. To produce a desirable shower of flaming droplets creating an attractive fireworks article the polyethylene should be a lower molecular weight low density polyethylene having an average molecular weight of less than about 100,000. It has been found that a particularly desirable display of a material with a relatively low cost has an average molecular weight of about 25,000 to 50,000. (Of course, these molecular weight figures can only be representative of a range; due to the nature of such materials.) The density is about 0.910 to 0.925 grams per cubic centimeter. The polyethylene of which plastic bags are typically made is excellent for the purpose of this invention. The term "molecular weight" as typically used in the polyethylene plastic industry refers to the number average molecular weight.

The material for hangers 20 and 44 should be of a non-combustible material such as wire capable of withstanding the heat produced by the burning bodies 10 and 40. Wicks 11, 46, 47 and 48 are of a material readily ignitable. Candle wicks are suitable, although hotter wicks such as dynamite fuses are even better.

Shields 30 and 50 are of a material sufficiently rigid to be self-supporting when spaced from the bodies 10 and 40. Additionally, shields 30 and 50 should be sufficiently strong to withstand wind force and of a sufficiently low combustibility to withstand the heat and occasional splatterings by burning material dropping from bodies 10 and 40. Examples of a suitable material for shields 30 and 50 are an inexpensive metal and, if sufficiently large to be spaced from the flames a sufficient amount, a cardboard material having a metalized heat and light reflecting surface. Shields 30 and 50 advantageously have a plurality of spaced ventilation openings 35. Openings 35 improve the flow of air within shields 30 and 50 to improve combustion of burning bodies 10 and 40, respectively. However, openings 35 are not so large that wind could pass through openings 35 and extinguish the combustion of bodies 10 and 40. A typical shield 30 has an axial length of about 6 inches, a diameter of about 2½ inches and a spacing between openings 35 of about 2 inches. Openings 35 also add measurably to the attractiveness of the fireworks device by providing for the emission of light from the burning body through the openings in the shield. As a result, the dropping flaming globules combine with relatively stationary points of light to provide an enhanced fireworks device. Although the points of light are relatively fixed because openings 35 are fixed, rotation or movement of the shield, due to wind, for example, does produce movement of the points of light and variations in the combustion of the burning body does produce a "twinkling" of the points of light.

OPERATION

Referring to FIGS. 2 and 4, flaming globules 60 are shown dropping from bodies 10 and 40. Hangers 20 and 44 are suspended from a support such as a clothesline or a nail so there is an area of free fall beneath bodies 10 and 40. Wicks 11, 46, 47 and 48 are ignited with a flame and burn toward bodies 10 and 40. Bodies 10 and 40 begin burning where the wick is attached and continue burning until all of bodies 10 and 40 are consumed. During the burning process the attractive flaming globules of body material drop downward with a curious zipping sound. Polyethylene is a particularly desirable material during this process because of its colorful burning characteristics and its lack of toxic by-products. When polyethylene burns it burns clean, in that water and carbon dioxide are given off. However, to obtain special effects it may be desirable to add a wax product to the polyethylene. The fireworks device stops producing flaming globules 60 when all of bodies 10 and 40 have been consumed. Combustion stops when all of bodies 10 and 40 have been consumed because hangers 20 and 44 are of a non-combustible material.

Various modifications and variations will no doubt occur to those skilled in the various arts to which this invention pertains. For example, the particular connection of the wick to the body of burnable material may be varied from that disclosed herein. These and all other variations which basically rely on the teachings through which this disclosure has advanced the art are properly considered within the spirit and broader aspects of this invention.

The embodiments of the invention in which an exclusive property or privilege is claimed are defined as follows:

1. A fireworks device comprising:

a body comprised substantially of a polyethylene material, said polyethylene material comprising the primary, active pyrotechnic ingredient of said fireworks device;

suspension means connected to said body;

ignition means connected to said body and being exposed; and said suspension means and said ignition means being oriented relative to one another and to said body such that said ignition means is located generally at the bottom of said body when said body is suspended by said suspension means.

2. A fireworks device as recited in claim 1 wherein the polyethylene of said body has average molecular weight of less than about 100,000.

3. A fireworks device as recited in claim 2 wherein the polyethylene of said body has an average molecular weight of about 25,000–50,000.

4. A fireworks device as recited in claim 3 wherein:

said body defines spaced top and bottom surfaces;

said suspension means comprising a hanger embedded in and extending from said top of said body; and said ignition means comprising a wick embedded in and extending from said bottom.

5. The fireworks display device of claim 4 comprising:

shield means of a material of sufficiently low combustibility to resist heat and splatterings from said body when it is burning, said shield means shielding at least the sides of said body from exposure to wind such that when the body is aflame, the flame does not readily blow out.

6. A fireworks device as recited in claim 5 wherein said shield means has spaced openings for ventilating and emitting light.

7. The fireworks display device of claim 1 comprising:

shield means of a material of sufficiently low combustibility to resist heat and splatterings from said body when it is burning, said shield means shielding at least the sides of said body from exposure to wind such that when the body is aflame, the flame does not readily blow out.

8. A fireworks device as recited in claim 1 wherein:

said body defines spaced top and bottom surfaces;

said suspension means comprising a hanger embedded in and extending from said top of said body; and said ignition means comprising a wick embedded in and extending from said bottom.

9. A fireworks device as recited in claim 8 further comprising:

said body having an elongated candle shape with one end of said candle comprising said top surface and the other said bottom surface;

a shield of a material of sufficiently low combustibility to resist heat and splatterings from said body when it is burning, said shield means having a hollow cylindrical shape with an open end partially enclosing said body, the central axis of said shield being approximately aligned with the central axis of said body, the open end of the shield exposing the end of said body containing said wick, for shielding said body from wind and preventing lateral splattering of burning polyethylene.

10. A fireworks device as recited in claim 9 wherein said shield means has spaced openings for ventilating and emitting light.

11. A fireworks device as recited in claim 1 wherein said body has a generally longitudinal elongated shape with a plurality of protrusions extending vertically downward, said ignition means comprising a wick embedded in each protrusion and extending from generally the lowest portion of said protrusion.

12. A fireworks device as recited in claim 11 further comprising:

a shield laterally surrounding the top and sides of said elongated shaped body and leaving the bottom of said protrusions of said elongated shaped body exposed.

13. The fireworks device of claim 1 in which said polyethylene is low density polyethylene.

14. The fireworks device of claim 13 in which said low density polyethylene has a density of from about 0.910 to about 0.925 grams per cubic centimeter.

15. A fireworks device comprising:

a body made of a substantially polyethylene flame dripping material;

suspension means connected to said body;

ignition means connected to said body and being exposed;

said suspension means and said ignition means being oriented relative to one another and to said body such that said ignition means is located generally at the bottom of said body when said body is suspended by said suspension means; and shield means of a material of sufficiently low combustibility to resist heat and splatterings from said body when it is burning said shield means housing said body in spaced relationship thereto for protecting said body from the wind, and said shield means being open at the bottom so as to expose the bottom of said body and said ignition means to said body can be ignited and drip flaming material.

16. A fireworks device as recited in claim 15 wherein said shield means has spaced openings for ventilating and emitting light.

* * * * *